US007901256B1

(12) United States Patent
Kiely

(10) Patent No.: US 7,901,256 B1
(45) Date of Patent: Mar. 8, 2011

(54) BONDING AND GROUNDING CLAMP/CONNECTOR FOR ELECTRODE CONDUCTORS

(75) Inventor: Kenneth M. Kiely, Milford, CT (US)

(73) Assignee: Bridgeport Fittings, Inc., Stratford, CT (US)

( * ) Notice: Subject to any disclaimer, the term of this patent is extended or adjusted under 35 U.S.C. 154(b) by 0 days.

(21) Appl. No.: 12/655,376

(22) Filed: Dec. 30, 2009

(51) Int. Cl.
*H01R 4/36* (2006.01)

(52) U.S. Cl. ..... 439/814

(58) Field of Classification Search ..... 439/810, 439/811, 814, 153; 174/78, 658, 663, 669
See application file for complete search history.

(56) References Cited

U.S. PATENT DOCUMENTS 2,974,185 A * 3/1961 Curtiss ..... 174/51
3,027,533 A * 3/1962 Monson ..... 439/95
7,537,467 B1 * 5/2009 Gretz ..... 439/108

* cited by examiner

*Primary Examiner* — Phuong K Dinh
(74) *Attorney, Agent, or Firm* — Alfred A. Fressola; Ware, Fressola, Van Der Sluys & Adolphson LLP

(57) ABSTRACT

By providing a single housing incorporating a central passageway or channel formed therein which is constructed for receiving and retaining a typical grounding rod/grounding electrode conductor and constructing the housing for being quickly and easily mounted and secured in a knockout hole formed in any desired electrical outlet box, junction box, meter box, or similar enclosure, an efficient, easily manufactured and easily assembled bonding and grounding clamp/connector is realized. Preferably, the housing of the clamp/connector of the present invention incorporates a locking screw threadedly mounted to the housing and positioned for quickly and easily securely affixing the grounding rod/grounding electrode conductor in the channel or passageway of the housing once positioned therein.

11 Claims, 2 Drawing Sheets

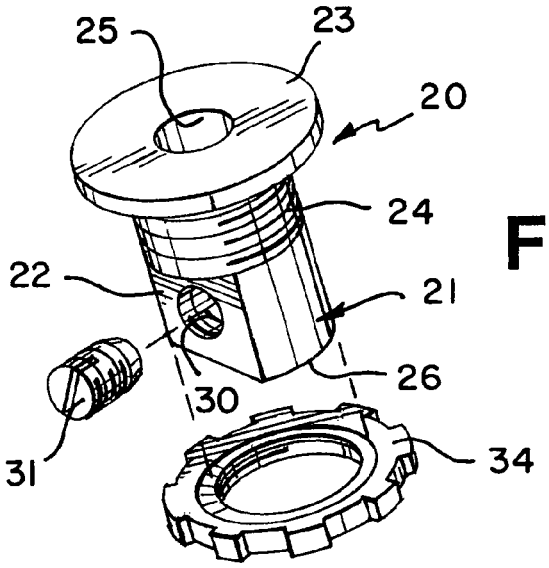
FIG. 1
FIG. 2
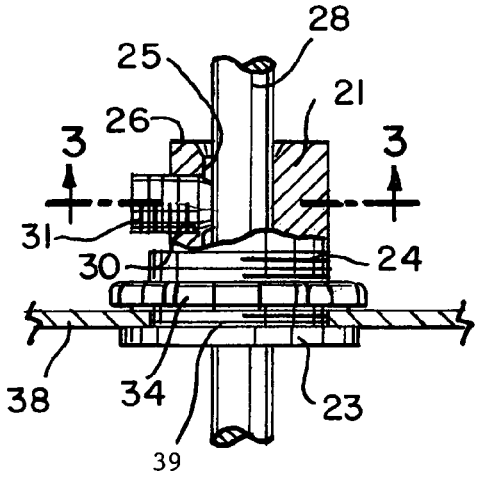
FIG. 3
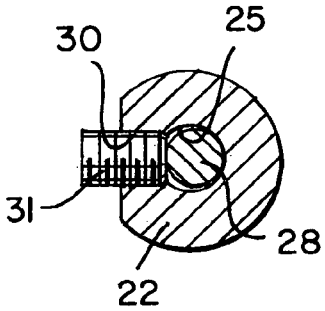
FIG. 4
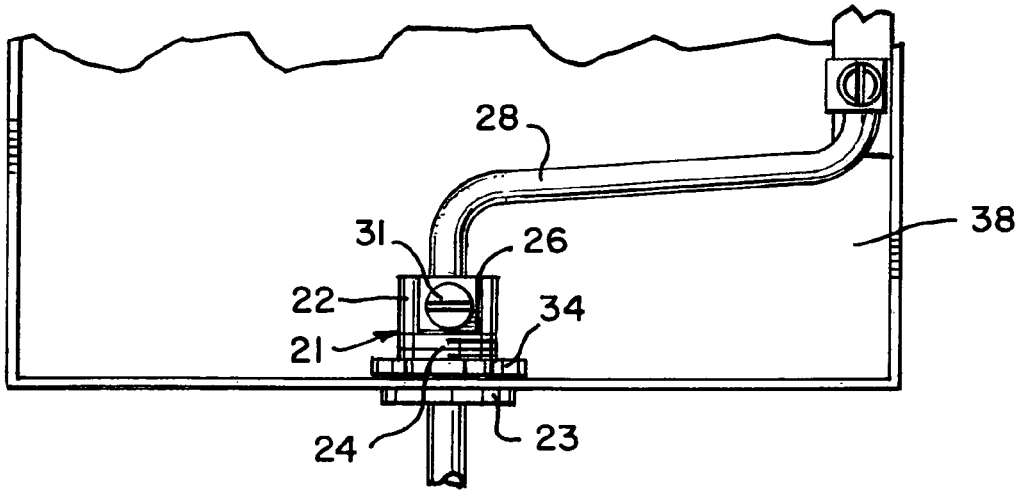

BONDING AND GROUNDING CLAMP/CONNECTOR FOR ELECTRODE CONDUCTORS

TECHNICAL FIELD

This invention relates to electrical connectors, and more particularly, to electrical clamps or connectors constructed for bonding and securing grounding electrode conductors to the housing of an electrical service box, meter box, or other electrical enclosure.

BACKGROUND OF THE INVENTION

In the field of wiring homes and buildings, whether for new construction or for improvements or expansion, substantial development and product improvements have been made. Typically, these improvements are directed to enabling installers to securely and safely mount any desired wiring to any desired location in the most efficient and quickest manner.

In any particular installation or location, various conduits or cables must be interconnected to each other as well as connected to the primary power supply in a suitable power distributing outlet box, junction box, meter box, or other enclosure. In these instances, flexible metal conduit and/or armor or metalclad cables within which the electrical power carrying wires are contained, must be securely mounted to the housing of a junction box or outlet box, or connected to an appropriate solid or rigid metal tubing or conduit.

In addition, in order to assure that the installed conduits or cables and the electrical power carrying wires contained therein are properly and safely installed for operation, power distributing outlet boxes, junction boxes, meter boxes, and other similar enclosures typically incorporate grounding electrode conductors which are interconnected to the power supply and extend from the particular box to a properly installed grounding rod or remote grounded location. In this way, all of the power carrying wires installed in the particular home or building are properly connected to a grounded location.

Although the requirement for properly securing a grounding rod or grounding electrode conductor to the power distributing outlet box, junction box, meter box, or other similar enclosure, in which the grounding rod/grounding electrode conductor is interconnected to the power carrying wires, commercially available products which are capable of achieving the desired mounted connection are both limited and expensive. Typically, these prior art products incorporate components which are expensive to manufacture due to tolerance requirements for enabling these components to peripherally surround and secure the grounding rod/grounding electrode conductor to the housing of the clamp or connector. Consequently, a need exists in the industry for the production of bonding and grounding clamp/connectors which are capable of being manufactured inexpensively, while also providing a high quality, highly effective and easily employed product.

Therefore, it is a principal object of the present invention to provide a bonding and grounding clamp/connector which is capable of being easily installed in any desired electrical outlet box, junction box, meter box, or similar enclosure for securing the grounding rod/grounding electrode conductor thereto.

Another object of the present invention is to provide a bonding and grounding clamp/connector having the characteristic features described above which is manufactured from easily produced components, thereby achieving a safe, effective, and cost efficient product.

Another object of the present invention is to provide a bonding and grounding clamp/connector having the characteristic features described above which virtually eliminates complicated installation techniques and achieves an easily installed product which is capable of being used by individuals of widely varied experiences.

Another object of the present invention is to provide a bonding and grounding clamp/connector having the characteristic features described above which enables the entire assembly and mounted engagement to be achieved quickly and easily by a single individual.

Other and more specific objects will in part be obvious and will in part appear hereinafter.

SUMMARY OF THE INVENTION

By employing the present invention, all of the difficulties and drawbacks of prior art systems have been eliminated and an efficient, easily manufactured and easily assembled bonding and grounding clamp/connector is realized. In accordance with the present invention, a single housing is constructed incorporating a central passageway or channel formed therein which is constructed for receiving and retaining a typical grounding rod/grounding electrode conductor. In addition, the housing is constructed for being quickly and easily mounted and secured in a knockout hole formed in any desired electrical outlet box, junction box, meter box, or similar enclosure. In this way, the clamp/conductor of the present invention is quickly and easily installed and secured in any desired location in any required electrical box.

Furthermore, the housing of the clamp/connector of the present invention incorporates a locking screw threadedly mounted to the housing and positioned for quickly and easily securely affixing the grounding rod/grounding electrode conductor in the channel or passageway of the housing once positioned therein. As a result, the entire installation of the clamp/connector of the present invention is achieved by longitudinally advancing any desired grounding rod/grounding electrode conductor through the channel or passageway of the housing of the clamp/connector, and then securing the grounding rod/grounding electrode conductor to the clamp/connector by threadedly advancing the locking screw into secure engagement with the grounding rod/grounding electrode conductor. Finally, the entire clamp/connector is inserted through a knockout hole formed in the desired electrical box and then securely mounted in the desired position.

In order to enable the clamp/connector of the present invention to be quickly and easily securely mounted to any desired electrical outlet box, junction box, meter box, or other enclosure, the clamp/connector preferably comprises a housing having a generally cylindrical shape and incorporates an enlarged flange formed at one end of the housing. In the preferred construction, the diameter of the enlarged flange is constructed for being greater than the diameter of a typical knockout hole of a typical electrical box. Furthermore, the housing incorporates a threaded zone formed on the outer surface thereof directly adjacent the enlarged flange, with the threaded zone being constructed for mating engagement with a locking ring.

In this way, the clamp/connector of the present invention is quickly and easily securely affixed to any desired junction box, meter box, outlet box, electrical box, and the like, by telescopically advancing the housing through a knockout hole formed in the particular box until the enlarged flange contacts the surface of the box, typically an inside surface.

Then, the locking ring is advanced onto the housing in threaded engagement with the threaded zone of the housing of the clamp/connector, with the locking ring being threadedly advanced until secure affixation of the clamp/connector with the box is achieved.

In this way, the clamp/connector of the present invention is securely affixed to any desired box. Furthermore, the grounding rod/grounding electrode conductor is securely mounted to the clamp/connector either before the clamp/connector is securely affixed to the desired box, or after its securement to the desired box, depending upon the particular type of installation being achieved or the desires of the installer.

The invention accordingly comprises an article of manufacture possessing the features, properties, and relation of elements which will be exemplified in the article hereinafter described, and the scope of the invention will be indicated in the claims.

THE DRAWINGS

For a fuller understanding of the nature and object of the invention, reference should be had to the following detailed description taken in connection with the accompanying drawings, in which:

FIG. 1 is an exploded perspective view of one embodiment of the clamp/connector of the present invention;

FIG. 2 is a cross-sectional view, partially broken away, of the clamp/connector of FIG. 1 shown fully assembled;

FIG. 3 is a cross-sectional view of the clamp/connector of the present invention taken along the line 3-3 of FIG. 2;

FIG. 4 is a front elevation view, partially broken away, of a conventional electrical enclosure depicting the clamp/connector of FIG. 1 mounted therein;

DETAILED DESCRIPTION

Figure 5:
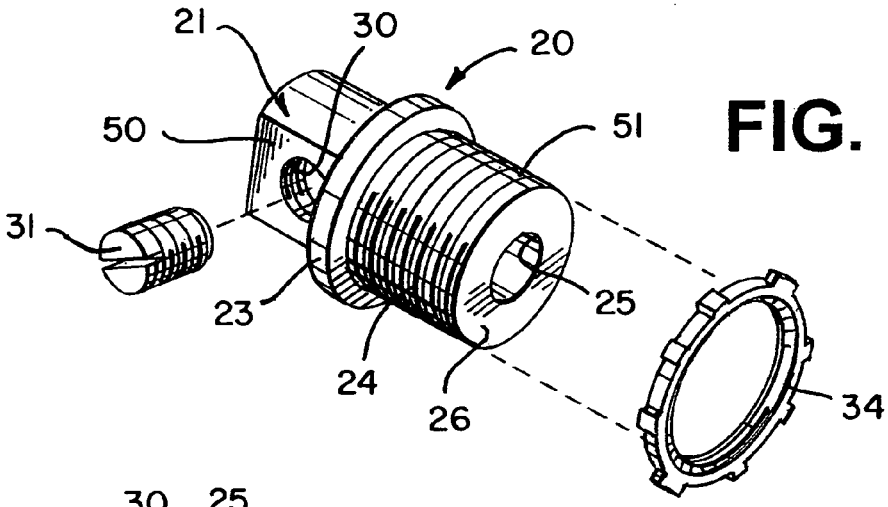
FIG. 5 is an exploded perspective view of an alternate embodiment of the clamp/connector of the present invention.

By referring to FIGS. 1-7, along with the following detailed disclosure, the construction and operation of two preferred alternate embodiments of the bonding and grounding clamp/connector of the present invention can best be understood. Although the following disclosure fully details each of the two alternate embodiments and presents the best mode for implementing the present invention, the bonding and grounding clamp/connector of the present invention can be constructed in further alternate configurations. Consequently, it is to be understood that the embodiments detailed herein are provided for exemplary purposes only and are not intended as a limitation of the present invention.

By referring to FIGS. 1-4, along with the following detailed disclosure, the construction and operation of one preferred embodiment of bonding and grounding clamp/connector 20 of the present invention can best be understood. As clearly depicted in these figures, bonding/grounding clamp/connector 20 comprises a housing member 21 which incorporates a generally cylindrical shaped portion 22 terminating at one end with enlarged flange 23.

As it more fully detailed below, enlarged flange 23 is constructed with an overall diameter which is greater than the diameter typically found in knockout holes formed in electrical outlet boxes, junction boxes, meter boxes, or similar enclosures. In this way, bonding and grounding clamp/connector 20 is easily positioned in the knockout hole formed in such electrical enclosures and securely mounted therein, with assurance that enlarged flange 23 will contact a surface of the enclosure and clamp/connector 20 will not pass completely through the knockout holes. As a result, an easily achieved, trouble free mounting of clamp/connector 20 with any desired electrical enclosure is attained.

As depicted in the figures, clamp/connector 20 also incorporates threaded zone 24 formed on the outer surface of cylindrical portion 22 of housing 21, preferably directly adjacent enlarged flange 23. In addition, central passageway or channel 25 is formed in housing the 21 axially extending completely through housing 21 from flange 23 to the opposed terminating end 26.

In order to achieve the desired goals and objectives of the present invention, central passageway/channel 25 comprises a diameter which enables any conventional grounding rod/grounding electrode conductor 28 to be easily inserted into passageway/channel 25 and axially advanced therethrough. In this way, grounding rod/grounding electrode conductor 28 associated with electrical outlet box, junction box, meter box, or other enclosure 38 is quickly and easily passed completely through passageway/channel 25 for enabling grounding rod/grounding electrode conductor 28 to be quickly and easily secured to bonding and grounding clamp/connector 20.

Bonding and grounding clamp/connector 20 also incorporates threaded aperture 30 formed in cylindrical portion 22 of housing 21, with threaded aperture 30 extending from the outer surface of cylindrical portion 22 and terminating at the juncture with passageway/channel 25. Furthermore, clamp/connector 20 incorporates threaded locking screw 31 which is mounted in threaded aperture 30 for enabling locking screw 31 to be axially moved in aperture 30 into and out of clamping engagement with any grounding rod/grounding electrode conductor 28 mounted in passageway/channel 25.

As is evident from the foregoing disclosure, once grounding rod/grounding electrode conductor 28 is axially passed through central passageway/channel 25 of bonding and grounding clamp/conductor 20, the grounding rod/grounding electrode conductor 28 is securely mounted in clamped engagement with clamp/connector 20 by threadedly advancing locking screw 31 in threaded aperture 30 until locking screw 31 is brought into clamping engagement of grounding rod/grounding electrode conductor 28 in passageway/channel 25, as clearly depicted in FIG. 3.

As discussed above, bonding and grounding clamp/connector 20 is employed to securely mount grounding rod/grounding electrode conductor 28 to any desired electrical outlet box, junction box, meter box, or other enclosure 38 which is required to complete a particular installation. In this regard, in order to enable bonding and grounding clamp/connector 20 to be quickly and easily securely affixed to enclosure 38, clamp/connector 20 incorporates locking ring 34, which is constructed for being threadedly engaged with threaded zone 24 of cylindrical portion 22.

As best seen in FIGS. 2 and 4, bonding and grounding clamp/connector 20 is quickly and easily inserted into knockout hole 39 formed in enclosure 38 and advanced therethrough until enlarged flange 23 contacts the surface of the enclosure 38. Thereafter, locking ring 34 is threadedly advanced on threaded zone 24 until locking ring 34 contacts the surface of enclosure 38, simultaneously bringing enlarged flange 23 into secure a abutting contact with the surface of enclosure 38, effectively clamping and securely mounting clamp/connector 20 in the desired position with enclosure 38. In this quick, simple, and straightforward manner, any desired grounding rod/grounding electrode conductor 28 associated with enclosure 38 is quickly and easily securely affixed to enclosure 38.

As discussed above, clamp/connector 20 may be mounted to enclosure 38 either prior to or after grounding rod/grounding electrode conductor 28 is secured to clamp/connector 20. If desired by the particular procedures of the installer, grounding rod/grounding electrode conductor 28 may be axially advanced through passageway/channel 25 of clamp/connector 20 prior to securing clamp/connector 20 to enclosure 38 as detailed above. Alternatively, if desired, clamp/connector 20 may be securely affixed to enclosure 38 followed by the axial advancement of grounding rod/grounding electrode conductor 28 through passageway/channel 25 of clamp/connector 20.

Regardless of which procedure is employed, the use of clamp/connector 20 of the present invention enables grounding rod/grounding electrode conductor 28 associated with any particular enclosure 38 to be securely affixed in the precisely desired position with bonding and grounding clamp/connector 20 quickly and easily. Furthermore, once mounted in position, the terminating end of grounding rod/grounding electrode conductor 28 is affixed to an appropriately installed ground clamp or ground rod clamp, in order to assure that the wiring of the particular building is properly installed.

Figure 6:
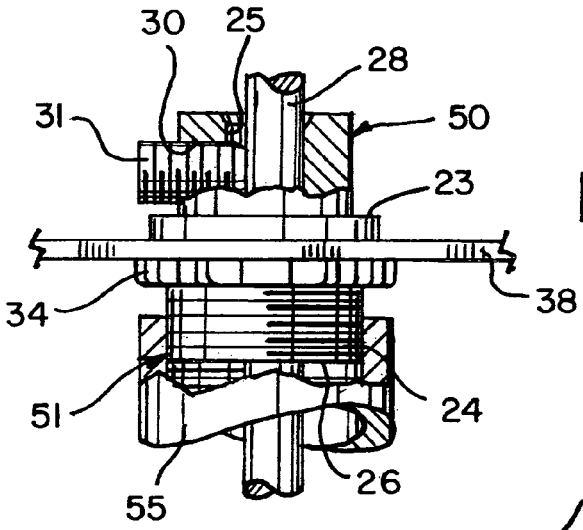
FIG. 6 is a cross-sectional view, partially broken away, of the clamp/connector of FIG. 5 shown fully assembled.
Figure 7:
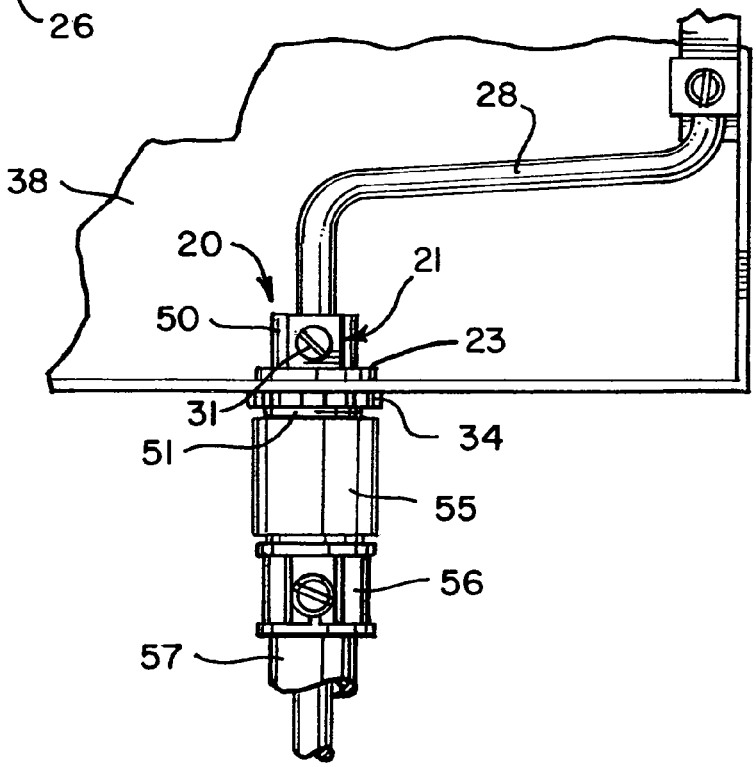
FIG. 7 is a front elevation view, partially broken away, of a conventional electrical enclosure depicting the clamp/connector of FIG. 5 mounted therein.

In FIGS. 5-7, a second preferred embodiment for bonding and grounding clamp/connector 20 of the present invention is depicted. By referring to these FIGURES, along with the following detailed discussion, the construction and operation of this alternate preferred embodiment can best be understood.

In this alternate embodiment, bonding and grounding clamp/connector 20 is constructed for enabling grounding rod/grounding electrode conductor 28 to be secured to any desired electrical outlet box, junction box, meter box, or other enclosure 38 wherein grounding rod/grounding electrode conductor 28 extending outwardly from enclosure 38 is mounted in a metallic or nonmetallic conduit or raceway. In order to achieve this construction, bonding and grounding clamp/connector 20 employs an alternate construction, while possessing all of the same attributes and construction elements detailed above in reference to FIGS. 1-4.

In this alternate embodiment, bonding and grounding clamp/connector 20 incorporates a generally cylindrically shaped housing member 21 which comprises first section 50 defining an upper portion of clamp/connector 20 and second section 51 defining the lower portion of clamp/connector 20. In addition, clamp/connector 20 incorporates enlarged flange 23 mounted substantially midway along the length of housing member 21 positioned between first section 50 and second section 51, effectively separating and defining sections 50 and 51. As with the embodiment detailed above, enlarged flange 23 comprises a diameter greater than the diameter typically found in knockout holes formed in electrical outlet boxes, junction box, meter boxes, or similar enclosures 38 in order to enable clamp/connector 20 to be quickly and easily mounted in a desired enclosure 38 with assurance that flange 23 will contact a surface of enclosure 38 and will not pass completely through the knockout hole associated therewith.

In addition, this alternate preferred embodiment also comprises central passageway/channel 25 formed in housing member 21 which axially extends completely through housing member 21 from one end to the opposed end thereof. As discussed above, the diameter of central passageway/channel 25 is constructed to enable any grounding rod/grounding electrode conductor 28 to be easily inserted into passageway/channel 25 and axially advanced therethrough for enabling grounding rod/grounding electrode conductor 28 to be quickly and easily secured to bonding and grounding clamp/connector 20.

Furthermore, in this embodiment of the present invention, bonding and grounding clamp/connector 20 incorporates threaded zone 24 formed in the outer surface of second section 51 directly adjacent enlarged flange 23. Threaded zone 24 is constructed for cooperating with locking ring 34 to enable locking ring 34 to be threadedly advanced onto threaded zone 24 of second section 51, in order to enable clamp/connector 20 to be quickly and easily securely affixed to any desired enclosure 38, in the manner detailed above.

As with the embodiment detailed above, this alternate embodiment of clamp/connector 20 incorporates threaded aperture 30 which is constructed for cooperating with locking screw 31 for securely affixing grounding rod/grounding electrode conductor 28 in elongated passageway/channel 25. In this embodiment, threaded aperture 30 is formed in first section 50, extending from the outer surface of first section 50 and terminating with central passageway/channel 25. In this way, locking screw 31 is movable in threaded aperture 30, enabling locking screw 31 to be advanced into and out of secure, abutting, clamping interengagement with grounding rod/grounding electrode conductor 28 for securely clamping and effectively locking grounding rod/grounding electrode conductor 28 in central passageway/channel 25.

As shown in FIGS. 6 and 7, this embodiment of the present invention is employed for securely mounting grounding rod/grounding electrode conductor 28 to any desired electrical outlet box, junction box, meter box, or other enclosure 38 which is required to complete a particular installation wherein grounding rod/grounding electrode conductor 28 exiting from enclosure 38 is to be positioned in a metallic or nonmetallic fitting, conduit, or raceway. In order to enable bonding and grounding clamp/connector 20 to be quickly and easily securely affixed to enclosure 38 with grounding rod/grounding electrode conductor 28 securely clamped thereto, clamp/connector 20 is constructed for being quickly and easily inserted into knockout hole 39 formed in enclosure 38 and securely mounted in the desired position. As discussed above, grounding rod/grounding electrode conductor 28 can be axially advanced into and securely affixed to clamp/connector 20 either before or after clamp/connector 20 is secured to enclosure 38.

In order to securely mount clamp/connector 20 to enclosure 38, this embodiment of clamp/connector 20 is advanced through knockout hole 39 of enclosure 38 from the inside of enclosure 38 in a manner which enables threaded zone 24 of second section 51 to pass through knockout hole 39 until enlarged flange 23 is brought into direct contact with an inside surface of enclosure 38. Then, locking ring of 34 is threadedly advanced onto threaded zone 24 of second section 51 and securely tightened in position, causing flange 23 and locking ring 34 to be securely mounted in position with enclosure 38.

Once this embodiment of clamp/connector 20 has been mounted in the manner detailed above, threaded zone 2424 of second section 51 extends outwardly from housing 38. As a result, grounding rod/grounding electrode conductor 28 is quickly and easily peripherally surrounded or inserted into metallic or nonmetallic conduit or raceway 57 to which fitting 56 is securely affixed. In addition, one end of coupling 55 is threadedly mounted to threaded zone 24 of second section 51, while the opposed end thereof is securely affixed to fitting 56. In this way, grounding rod/grounding electrode conductor 28 is quickly and easily installed in protective, surrounding relationship with the desired conduit or raceway for assuring the required affixation of grounding rod/grounding electrode conductor 28 to the installed grounding components.

In order to assure that both preferred embodiments of bonding and grounding clamp/connector 20 of the present invention operates in the desired manner, both embodiments of clamp/connector 20 are preferably constructed from materials which will provide the desired electrical conductivity, such as aluminum, copper, alloys thereof, and other similar materials. In addition, the components forming clamp/connector 20 are constructed to provide secure affixation and locked interengagement of grounding rod/grounding electrode conductor 28 in central passageway/channel 25 of clamp/connector 20 in a manner which will meet or exceed all code requirements.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim is new and desire to secure by Letters Patent is:

The invention claimed is:

1. A bonding and grounding clamp/connector constructed for mounted engagement in an electrical enclosure, said clamp/connector comprising:

A. a generally cylindrically shaped member incorporating a first end and a second end;

B. an enlarged flange radially extending outwardly from said cylindrically shaped member and constructed for abutting contact with a surface of the electrical enclosure;

C. a threaded zone formed on the outside surface of the cylindrically shaped member and positioned adjacent the enlarged flange;

D. an elongated, longitudinally extending passageway a) formed in said cylindrically shaped member and extending completely through the member from said first end to said second end, and b) dimensioned for receiving and retaining an elongated, continuous, grounding rod/grounding electrode conductor;

E. a threaded aperture formed in the cylindrically shaped member, extending from the outside surface thereof into said cylindrically shaped member and terminating with the elongated, longitudinally extending passageway;

F. a locking screw mounted in said threaded aperture for threaded engagement therewith, enabling said locking screw to be advanced into and out of locking engagement with a grounding rod/grounding electrode conductor positioned in said elongated, longitudinally extending passageway; and G. a locking ring constructed for threaded interengagement with the threaded zone formed on the outside surface of the cylindrically shaped member for cooperating with the enlarged, radially extending flange for enabling said clamp/connector to be securely affixed to the electrical enclosure through an opening therein so that said locking screw mounted in said threaded aperture is positioned inside said electrical enclosure.

2. The bonding and grounding clamp/connector defined in claim 1, wherein said enlarged radially extending flange is further defined as comprising a diameter greater than the diameter of a conventional knockout hole formed in an electrical enclosure, thereby enabling said clamp/connector to be inserted in a knockout hole of an electrical enclosure and retained therewith.

3. The bonding and grounding clamp/connector defined in claim 2, wherein said the enlarged flange is further defined as being formed on the first end of said cylindrically shaped member, enabling said clamp/connector to be inserted into the knockout hole of an electrical enclosure with the flange contacting an exterior surface of the electrical enclosure while the threaded zone is positioned inside the enclosure, and said clamp/connector is securely affixed to the electrical enclosure by securing the locking ring on the threaded zone in contact with the inside surface of the electrical enclosure.

4. The bonding and grounding clamp/connector defined in claim 3, wherein a grounding rod/grounding electrode conductor is securely affixed to said clamp/connector by axially advancing the grounding rod/grounding electrode conductor through the longitudinally extending passageway and threadedly advancing the locking screw into secure affixed interengagement with said grounding rod/grounding electrode conductor.

5. The bonding and grounding clamp/connector defined in claim 1, wherein said clamp/connector is further defined as being constructed from electrically conductive material in order to provide desired conductivity.

6. The bonding and grounding clamp/connector defined in claim 5, wherein said electrically conductive material is further defined as comprising one selected from the group consisting of aluminum, copper, and alloys thereof.

7. The bonding and grounding clamp/connector defined in claim 1, wherein said enlarged flange is further defined as being formed along the length of said cylindrically shaped member effectively defining an upper section and a lower section.

8. The bonding and grounding clamp/connector defined in claim 7, wherein said lower section is further defined as comprising a threaded zone formed on the outer surface thereof substantially in its entirety.

9. The bonding and grounding clamp/connector defined in claim 8, wherein the threaded aperture is further defined as being formed in the upper section extending from the outer surface thereof into said upper section and terminating with the elongated, longitudinally extending passageway.

10. The bonding and grounding clamp/connector defined in claim 9, wherein said enlarged flange is further defined as comprising a diameter greater than the diameter of a conventional knockout hole formed in the electrical enclosure for enabling said clamp/connector to be inserted into the knockout hole from inside said enclosure with the upper section thereof retained inside the enclosure and the lower section thereof, with its threaded zone, extending outwardly therefrom for secure engagement with the locking ring.

11. The bonding and grounding clamp/connector defined in claim 10, wherein the threaded zone of the lower section is positioned for enabling threaded interengagement with a coupling affixed to a metallic or nonmetallic conduit or raceway for enabling the grounding rod/grounding electrode conductor to be positioned in and protected by said conduit/raceway.

* * * * *